US008382526B2

(12) United States Patent
Chen et al.

(10) Patent No.: US 8,382,526 B2
(45) Date of Patent: Feb. 26, 2013

(54) POWER ADAPTER WITH INTERCHANGEABLE CONNECTORS AND POWER SUPPLY HAVING THE SAME

(75) Inventors: Chun-Chen Chen, Taoyuan Hsien (TW); Wei-Kai Hsiao, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/188,168

(22) Filed: Jul. 21, 2011

(65) Prior Publication Data

US 2012/0021653 A1 Jan. 26, 2012

(30) Foreign Application Priority Data

Jul. 23, 2010 (TW) ..... 99124456 A

(51) Int. Cl.
*H01R 25/00* (2006.01)

(52) U.S. Cl. ..... 439/655; 439/518; 439/173

(58) Field of Classification Search ..... 439/518, 439/655, 171–175
See application file for complete search history.

(56) References Cited

U.S. PATENT DOCUMENTS 4,973,827 A * 11/1990 Nozaki ..... 219/521
5,613,863 A * 3/1997 Klaus et al. ..... 439/131
5,634,806 A * 6/1997 Hahn ..... 439/173
5,684,689 A * 11/1997 Hahn ..... 363/146
5,848,907 A * 12/1998 Chen ..... 439/172
5,934,921 A * 8/1999 Doong ..... 439/172
6,086,395 A * 7/2000 Lloyd et al. ..... 439/172
6,109,977 A * 8/2000 Baxter et al. ..... 439/693
6,227,888 B1 * 5/2001 Hahn ..... 439/173
6,261,109 B1 * 7/2001 Liu et al. ..... 439/131
6,544,058 B1 * 4/2003 Chang ..... 439/173
6,845,023 B2 * 1/2005 Philips et al. ..... 363/132
6,923,667 B1 * 8/2005 Chen ..... 439/172
6,988,903 B1 * 1/2006 Cheng ..... 439/137
7,008,246 B2 * 3/2006 Zhuge ..... 439/173
7,168,969 B1 * 1/2007 Wang ..... 439/173
7,179,105 B1 * 2/2007 Hung ..... 439/172
7,264,492 B2 * 9/2007 Liang ..... 439/171
7,265,517 B2 * 9/2007 Bumiller ..... 320/114
7,300,297 B1 * 11/2007 Wang ..... 439/173
7,547,219 B2 * 6/2009 Zhuge ..... 439/173
7,563,115 B2 * 7/2009 van gen Hassend et al. . 439/171
7,601,023 B1 * 10/2009 Ma et al. ..... 439/518
7,621,765 B1 * 11/2009 Wu ..... 439/173
7,632,119 B1 * 12/2009 Ma et al. ..... 439/172
7,632,137 B1 * 12/2009 Ma et al. ..... 439/518
7,654,838 B1 * 2/2010 Zhuge ..... 439/173
7,753,721 B1 * 7/2010 Wu ..... 439/518
7,794,251 B2 * 9/2010 Wen et al. ..... 439/173
7,874,853 B2 * 1/2011 Chiang et al. ..... 439/173
7,946,884 B2 * 5/2011 Chiang et al. ..... 439/518
7,950,938 B1 * 5/2011 Teoh ..... 439/171

(Continued)

*Primary Examiner* — Ross Gushi
(74) *Attorney, Agent, or Firm* — Kirton McConkie; Evan R. Witt

(57) ABSTRACT

There is disclosed a power adapter which comprises an adapter body and a modular connector. The adapter body has a cavity forming a first opening and a second opening respectively disposed on two adjacent lateral walls of the adapter body, a first connecting member disposed on one of the lateral walls and adjacent to the first opening, and a sliding plate member having a sliding plate embedded in a slide and protrusible in said second opening. The connector is interchangeably coupled to the cavity and blocked by the sliding plate to form an electrical connection with the adapter body, and comprises a second connecting member engaged with the first connecting member.

18 Claims, 10 Drawing Sheets

U.S. PATENT DOCUMENTS

| | | | | |
|---|---|---|---|---|
| 8,033,847 | B1 * | 10/2011 | Chen | 439/172 |
| 8,052,441 | B2 * | 11/2011 | Senatori et al. | 439/171 |
| 8,087,946 | B2 * | 1/2012 | Namiki et al. | 439/173 |
| 8,215,976 | B2 * | 7/2012 | Peng et al. | 439/345 |
| 8,226,424 | B1 * | 7/2012 | Wang et al. | 439/172 |
| 2003/0211767 | A1 * | 11/2003 | Philips et al. | 439/170 |
| 2004/0132328 | A1 * | 7/2004 | Wu | 439/172 |
| 2005/0136717 | A1 * | 6/2005 | Lai | 439/170 |
| 2005/0176281 | A1 * | 8/2005 | Zhuge | 439/173 |
| 2007/0032109 | A1 * | 2/2007 | Hung | 439/172 |
| 2007/0238341 | A1 * | 10/2007 | So | 439/172 |
| 2009/0117765 | A1 * | 5/2009 | Wen et al. | 439/166 |
| 2010/0120278 | A1 * | 5/2010 | Yang | 439/171 |
| 2010/0173526 | A1 * | 7/2010 | Chiang et al. | 439/620.1 |
| 2011/0053410 | A1 * | 3/2011 | Namiki et al. | 439/518 |
| 2012/0021653 | A1 * | 1/2012 | Chen et al. | 439/655 |

* cited by examiner

POWER ADAPTER WITH INTERCHANGEABLE CONNECTORS AND POWER SUPPLY HAVING THE SAME

FIELD OF THE INVENTION

The present invention relates to a power adapter and a power supply having the same, and more particularly to an improved power adapter structure which provides protection for firmly locking the interchangeable connectors into position and a power supply containing the improved power adapter.

BACKGROUND OF THE INVENTION

Power adapters are known to be used to convey power to a wide variety of electronic devices, and readily to be a power supply to convert power for operating the same or charging batteries when equipped with a power conversion circuit. Since the connector designs in use vary from country to country and from device to device, it is a serious disadvantage for manufacturers to build variety of power adapters with different fixed connector configuration in responding. It also causes great inconvenience to the users in traveling since all the different power adapters for the case are required being available. Consequently, power adapters equipped with removable and interchangeable connectors are thus in demand.

Some similar solutions have been developed. They normally include a removable and interchangeable connector, and a housing capable to be coupled with the connector. When it is constructed in a power supply, a power conversion circuit to convert the power is further required. FIG. 1 shows an exploded view of a conventional power adapter; and FIG. 2 is a conventional power supply which further comprises the power conversion circuit (not shown) embedded in the housing of the power adapter. As illustrated in FIG. 1, the conventional power adapter 1 includes a housing 11 and a connector 12. The connector 12 has two flanges 121 respectively placed on its two opposite sides. The connector 12 is coupled to the housing 11 by way of the two flanges 121 sliding into a slot 111 of the housing 11 according to the route as illustrated. A hook 112 of the housing 11 is configured to engage with a mating notch 122 of the connector 12 so as to further secure the connector 12 to the housing 11. There are two sliding chute 123 respectively disposed on the bottom of the connector 12 adjacent to the two opposite sides with the flanges 121 and configured to accommodate two projecting contacts 113 of the housing 11 sliding into. The connector 12 includes conducting prongs 124 to receive power from outside power sources, and conductive contacts (not shown) embedded in the sliding chute 123. The projecting contacts 113 slide into the sliding chute 123 and are connected with the embedded conductive contacts so as to convey the received power.

As illustrated in FIG. 2, the conventional power supply 2 is constructed by basically using the same structure as in FIG. 1, and further equipped with a power conversion circuit (not shown) embedded in the housing 11 to convert the power received from the connector 12 to an electronic device by way of an output power cord 21. In this conventional design, the connector 12 can be removed from the housing 11 by pressing down a pressing portion 114 of the housing 11 to sink the hook 112 and release the engagement, as shown in FIGS. 1 and 2.

The conventional way has been widely used by the industry for solving the flexibility problem in use. However, several disadvantages have emerged, and have been brought into attention when serious safety issues involved.

When the connector 12 embedded into the housing 11 and transferring the received power, the full and firm positioning of the connector 12 is required. This would provide reliable electrical safety in use and seriously rely upon the engagement construction between the connector 12 and the housing 11. As illustrated, the engagement construction in the conventional way to make sure the securing and positioning depends on the block jointly provided by the hook 112 and the mating notch 122. Apparently, such engagement is very likely hard to hold long under expected outside forces during the normal use, and even tends to fail under normal wear and tear. The damage caused by the disengagement or any kind of failure of the engagement can be huge.

It is easily understood that the main purposes of these conventional designs are for obtaining flexibility in use, providing reliable and qualified power and avoiding any safety issues. The conventional way couldn't fully meet the needs that are in demand.

SUMMARY OF THE INVENTION

It is an object of the present invention to provide a power adapter with interchangeable connectors and a power supply having the same, in which the coupling between the connector and the housing is secure, the connector is firmly enclosed by the housing, and the electrical safety can be improved.

It is another object of the present invention to provide a power adapter with interchangeable connectors and a power supply having the same, in which the connector is capable of being fully positioned so as to transfer reliable power.

It is a further object of the present invention to provide a power adapter with interchangeable connectors and a power supply having the same, in which the connectors are modularized and the conducting terminals of the connectors are specially designed to comply with various connector regulations so that the power adapter is more user-friendly and easily stored.

It is a further object of the present invention to provide a power adapter with interchangeable connectors and a power supply having the same, in which the orientation of the connector is changeable according to the practical requirements so that the space utilization is enhanced.

In accordance with an aspect of the present invention, there is provided a power adapter comprising an adapter body and a connector. The adapter body has a first lateral wall, a second lateral wall adjacent to the first lateral wall, a cavity forming a first opening and a second opening respectively disposed on two adjacent lateral walls of the adapter body, a first connecting member disposed adjacent to a rim of the first opening of the cavity, and a sliding plate member having a sliding plate embedded in a slide of the second lateral wall and protrusible in the second opening. The connector is interchangeably coupled to the cavity and has a second conducting member and a second connecting member, wherein the second conducting member is coupled to the first conducting member. The sliding plate is configured to urge against the connector for restraining the connector from moving toward the second opening; and the second connecting member is configured to engage with the first connecting member for restraining the connector from moving toward the first opening.

In accordance with another aspect of the present invention, there is provided a power supply comprising the power adapter and a power conversion circuit embedded in the adapter body for converting the power received from the connector.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
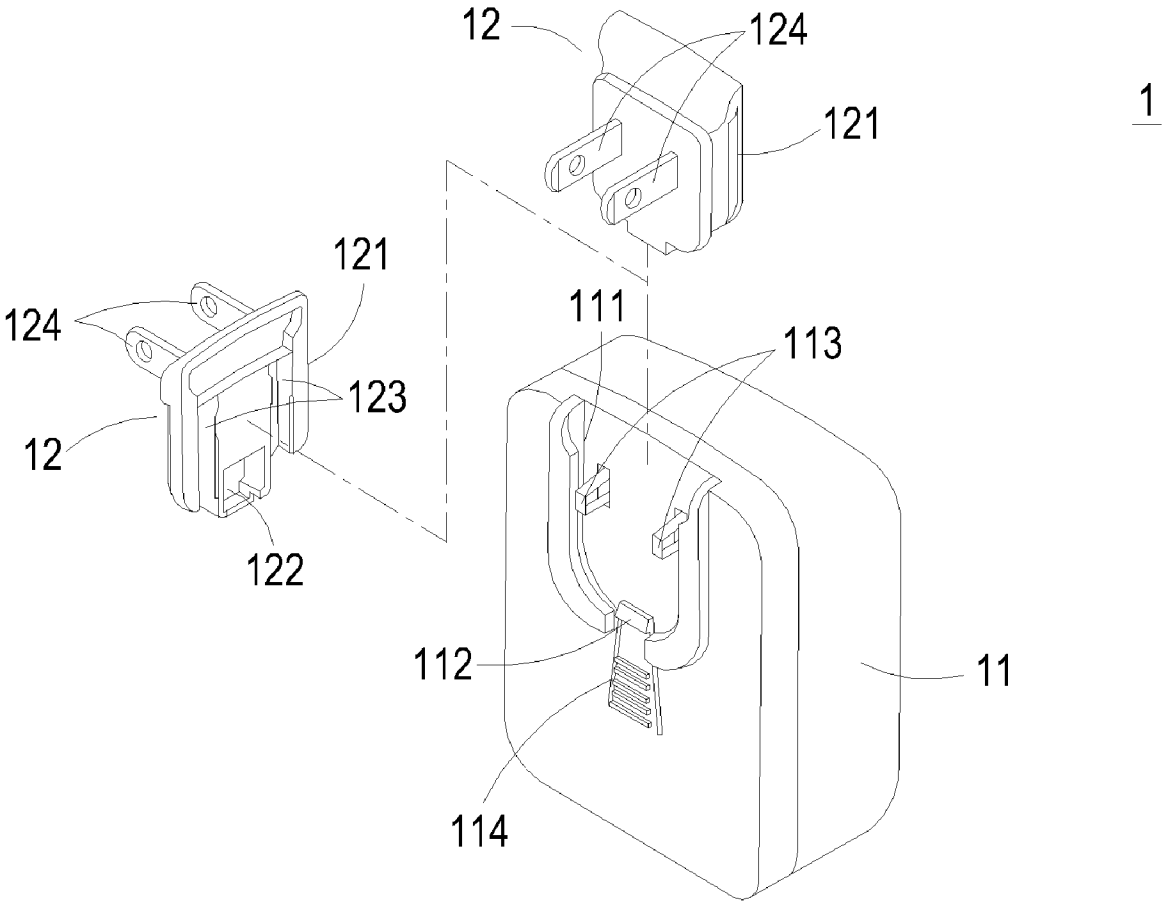
FIG. 1 PRIOR ART
FIG. 1 is an exploded view schematically showing a conventional power adapter.
Figure 2:
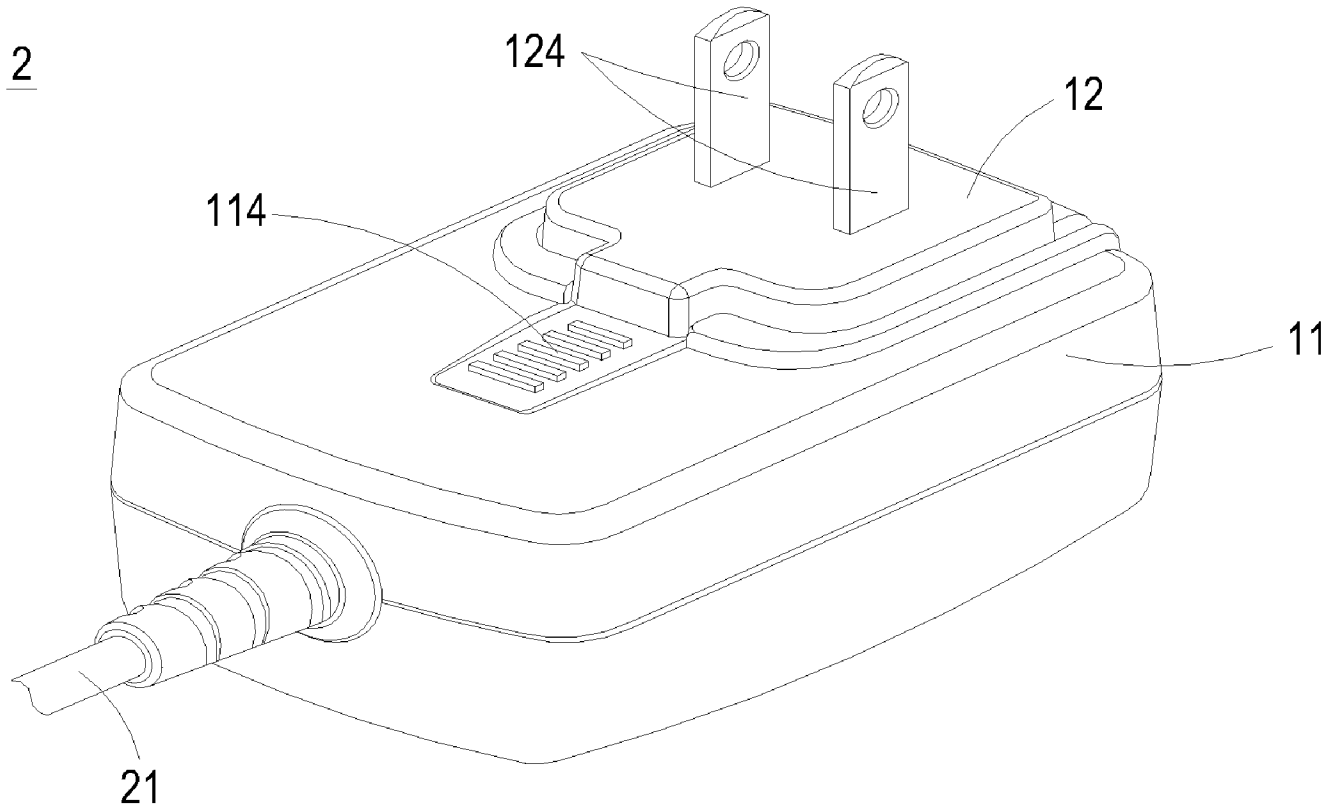
FIG. 2 PRIOR ART
FIG. 2 illustrates an assembled view schematically showing a conventional power supply employing the primary structure of the conventional power adapter as in FIG. 1.
Figure 3B:
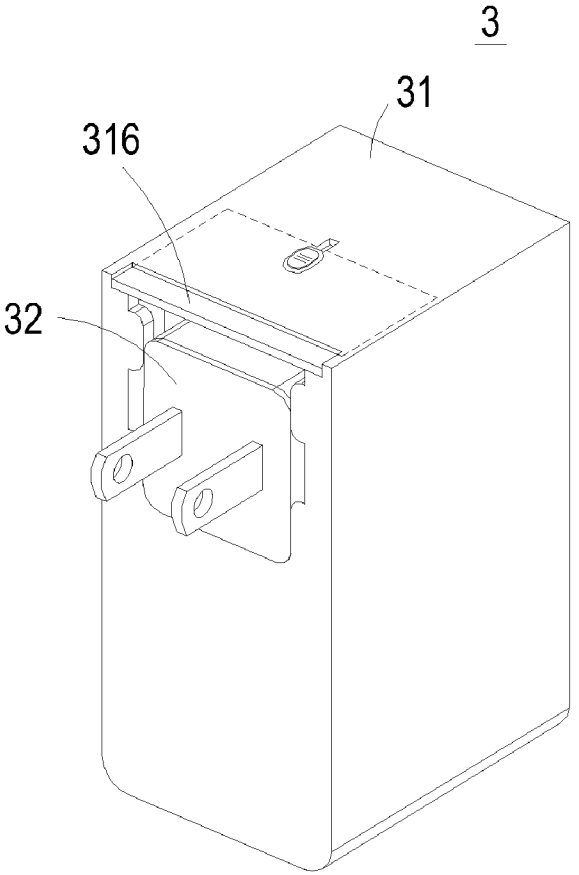
FIG. 3B is an assembled view schematically showing the power adapter as in FIG. 3A.
Figure 3A:
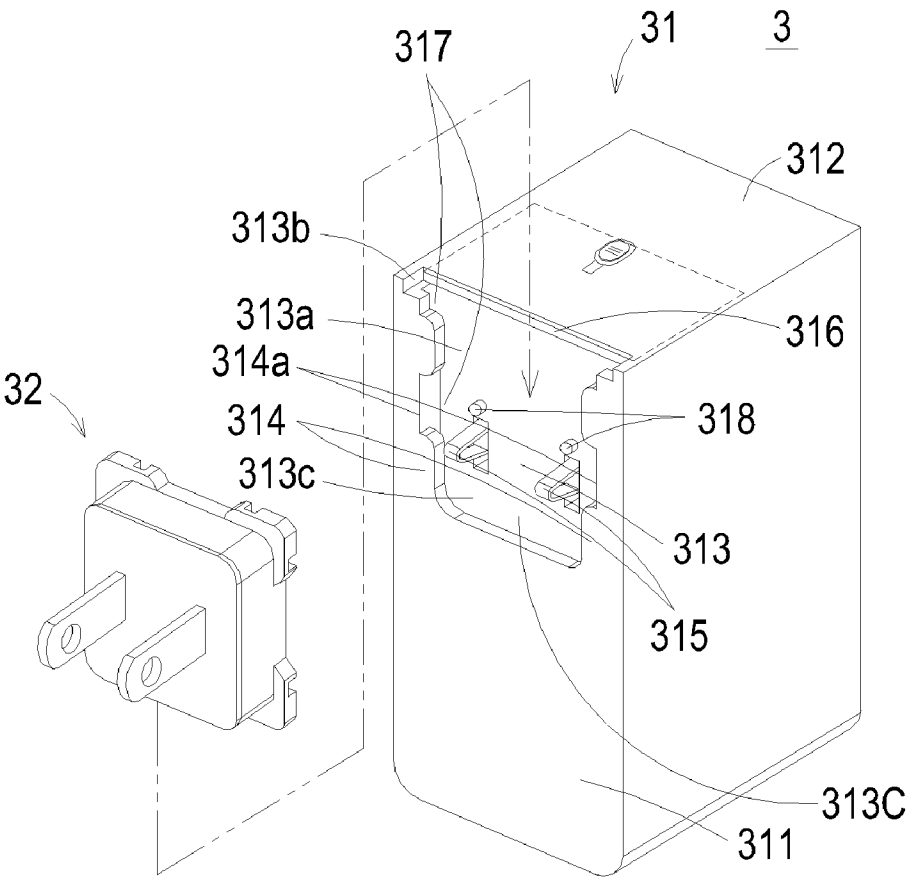
FIG. 3A is an exploded view schematically showing a power adapter with an interchangeable connector according to one embodiment of the invention.

FIG. 3A and FIG. 3B respectively illustrate an exploded and assembled view of a power adapter according to one embodiment of the invention. The power adapter 3 includes an adapter body 31 and a connector 32. The adapter body 31 includes a first lateral wall 311, a second lateral wall 312 adjacent to the first lateral wall 311, a cavity 313, a first connecting member 314, a first conducting member 315, and a sliding plate member 316. The cavity 313 is substantially disposed on the first lateral wall 311, and separately forms a first opening 313*a* on the first lateral wall 311 and a second opening 313*b* on the second lateral wall 312. In this embodiment, the first connecting member 314 is constructed as a flange disposed adjacent to the rim of the first opening 313*a* of the cavity 313. A guiding groove 317 is formed between the first connecting member 314 and a bottom base 313*c* of the cavity 313. There are at least two breaches 314*a* symmetrically disposed on the first connecting member 314. The first conducting member 315 is placed on a bottom base 313*c* of the cavity 313. In one preferred embodiment, the first conducting member 315 is two elastic conducting laminates.

Figure 4:
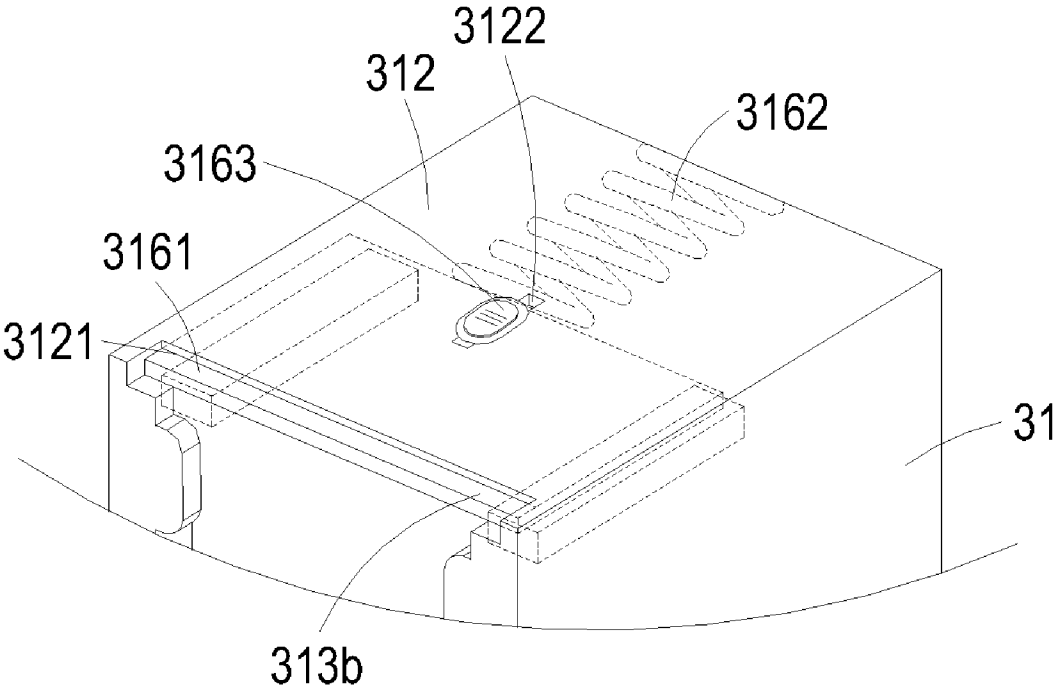
FIG. 4 is a perspective view schematically showing a sliding plate member according to one embodiment of the invention.

FIG. 4 illustrates a detailed sliding plate member of the power adapter as in FIG. 3A and FIG. 3B. The sliding plate member 316 of the adapter body 31 includes a sliding plate 3161 and a holding unit 3162. The sliding plate 3161 is embedded in a slide 3121 of the second lateral wall 312 and protrusible in the second opening 313*b*. The holding unit 3162 is disposed inside the adapter body 31, and coupled with the sliding plate 3161 to provide force to the sliding plate 3161 in order to hold the sliding plate 3161 in a desired position. The sliding plate member 316 can further include a position controller 3163 to manage the projecting position of the sliding plate 3161 in the second opening 313*b*. In a preferred embodiment, the second lateral wall 312 further includes a slide opening 3122. The position controller 3163 is coupled with the sliding plate 3161, pierces through the slide opening 3122, and protrudes out of the second lateral wall 312.

The holding unit 3162 of the sliding plate member 316 can be an elastic component which is capable of holding the sliding plate 3161 protruding in or being withdrawn from the second opening 313*b* until another forces added. But it is well known to those skilled in the art that there are many similar arrangements and variants in holding and may be used here. For example, it could be a serrate construction arranged along the two opposite side of the sliding plate 3161, and the holding unit 3162 has a corresponding structure. The resulting friction may hold the plate in a desired position. In a preferred embodiment, the holding unit 3162 is a metallic or plastic spring coil to keep the sliding plate 3161 to stay in the second opening 313*b*. In one embodiment, the connector 32 enters into the cavity 313 of the adapter 31 by way of either the first opening 313*a* or the second opening 313*b*. The sliding plate 3161 can be pressed down by the connector 32 and withdrawn from the second opening 313*b* so as to slide the connector 32 into the cavity 313, and the sliding plate 3161 shall move back to block the second opening 313*b* when the connector 32 finishes the coupling. The position controller 3163 can also be used here to make the plate 3161 hold in a particular position.

Figure 5B:
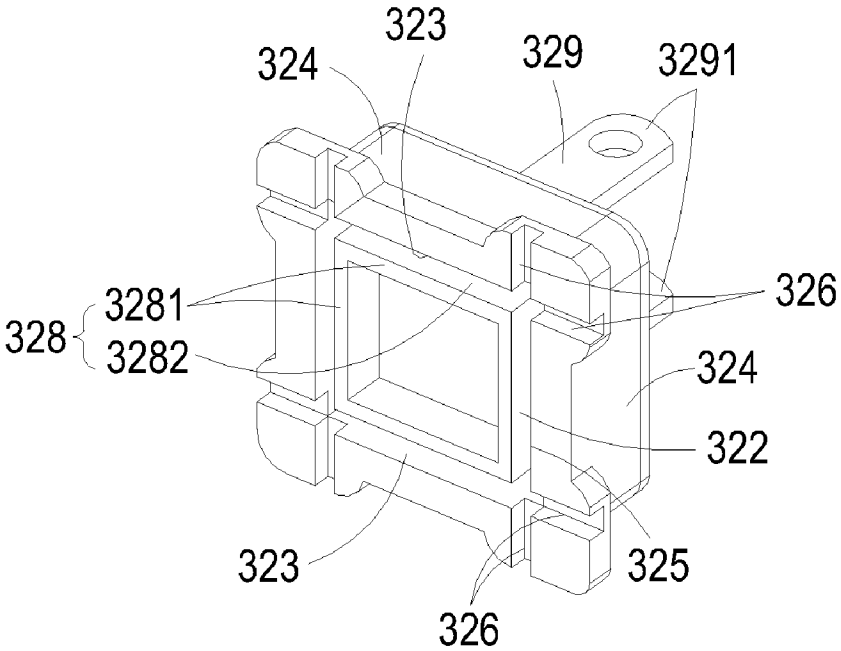
FIG. 5B is a bottom view schematically showing the interchangeable connector as in FIG. 5A.
Figure 5A:
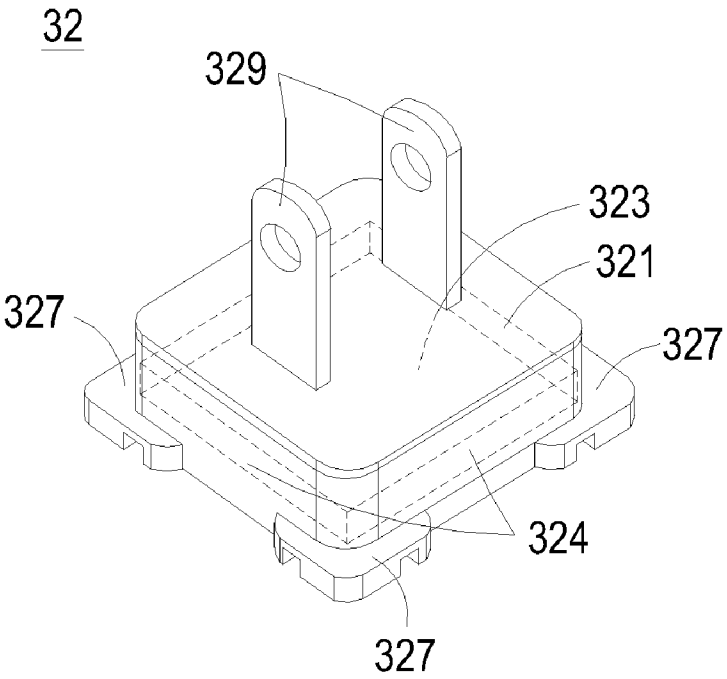
FIG. 5A is a perspective view schematically showing an interchangeable connector according to one embodiment of the invention.
Figure 5C:
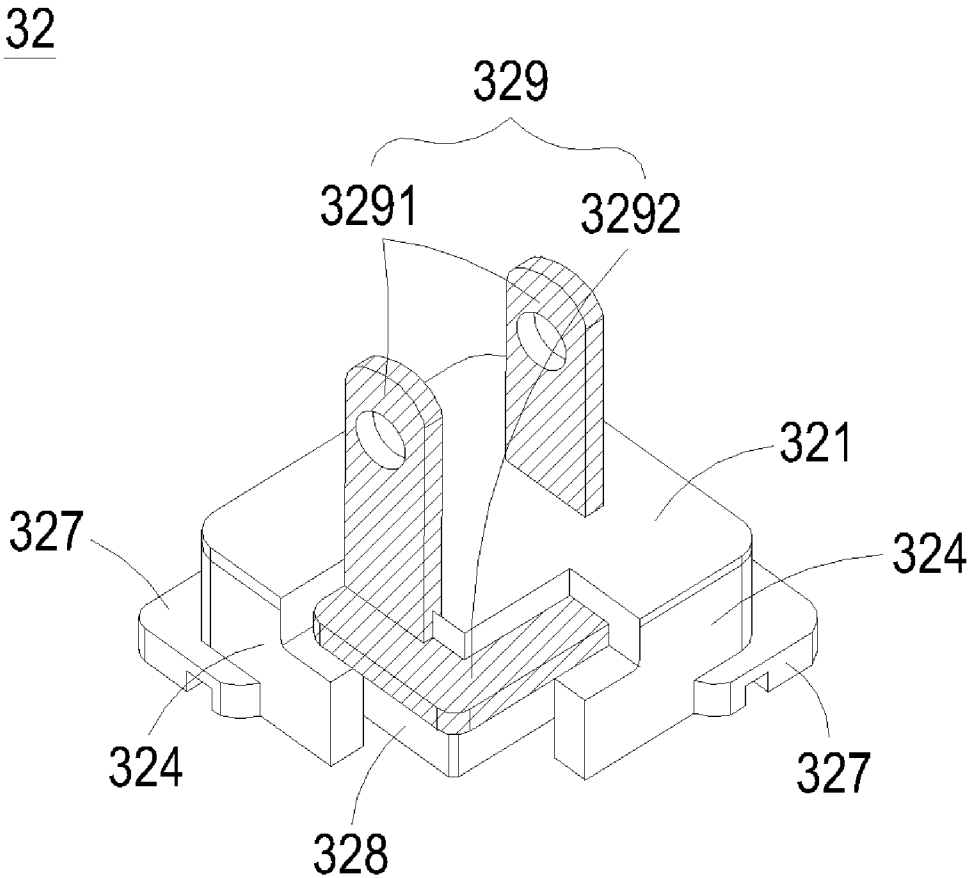
FIG. 5C is a sectional view schematically showing the interchangeable connector as in FIG. 5A and FIG. 5B.
Figure 6:
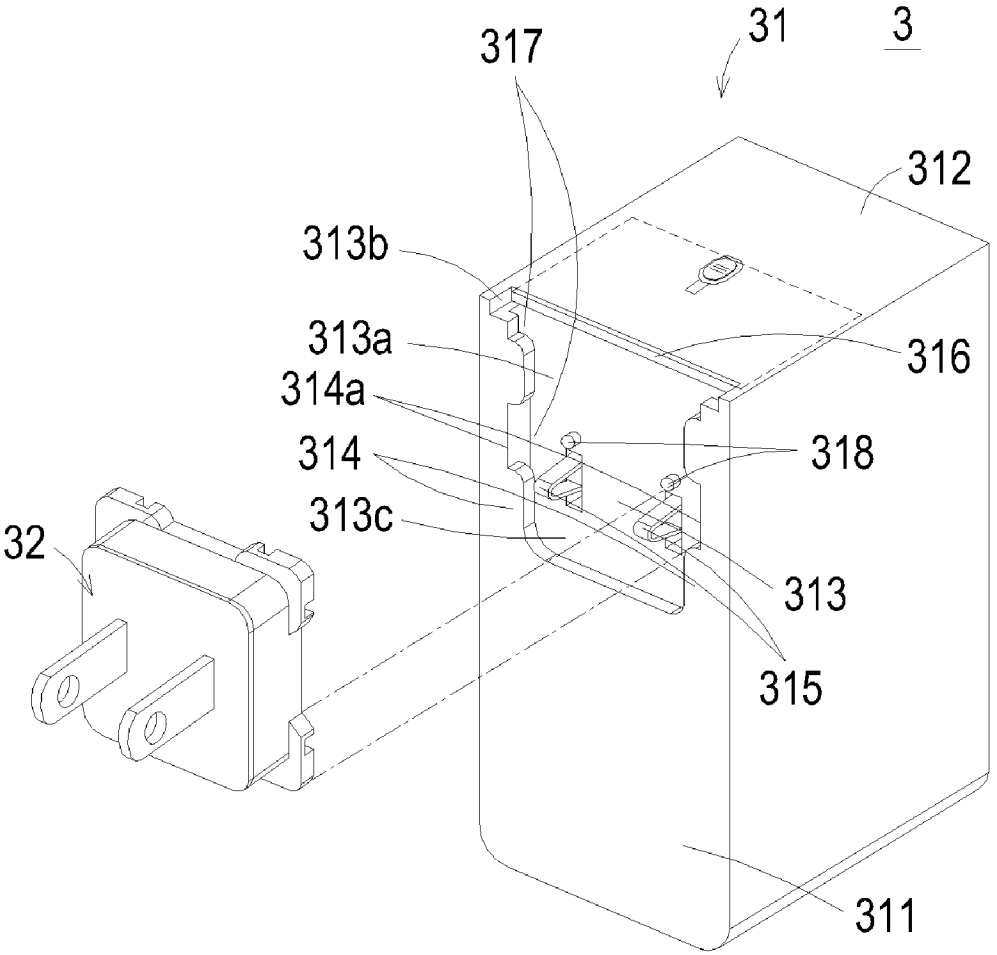
FIG. 6 illustrates an exploded view of a power adapter schematically showing a way to connect an adapter body with the interchangeable connector according to one embodiment of the invention.

FIGS. 5A, 5B and 5C respectively illustrate a front view, bottom view and sectional view of an interchangeable connector according to one embodiment of the present invention. As shown in FIGS. 5A, 5B and 5C together with FIGS. 3A and 3B, the connector 32 includes a top end 321 and a bottom end 322 opposite to the top end 321. The bottom end 322 is capable of being coupled to the cavity 313 by way of either the first opening 313*a* between the breaches 314*a* of the first connecting member 314, or the second opening 313*b*, as respectively shown in FIG. 6 and FIG. 3A.

The connector 32 further includes a sunken portion 323 which is enclosed and defined by a plurality of connector side walls 324 along with the top end 321. There is a bottom opening 325 formed on the bottom of the sunken portion 323. The connector side walls 324 connected with the top end 321 and the bottom end 322 has a second connecting member 327 protruding outwardly. In this embodiment, the second connecting member 327 formed by a plurality of protrusion blocks, but there are many other similar solutions known to any skilled one in the art. The second connecting member 327 may enter into the guiding groove 317 by way of either the first opening 313*a* between the breaches 314*a*, or the second opening 313*b*, so as to settle the connector 32 in the cavity 313 and finish the coupling between the connector 32 and the adapter body 31.

As illustrated, the connector 32 is approximately a cube in shape. There are four protrusion blocks of the second connecting member 327 symmetrically disposed on the four corners of the of the connector side walls 324. This makes a further flexibility in assembly direction when coupling and securing the connector 32 to the adapter body 31.

As shown in another embodiment in FIGS. 5A, 5B and 5C, the connector 32 may include a socket unit 328 placed on the sunken portion 323 to receive the first conducting member 315. The connector 32 also includes a second conducting member 329 which includes a first contact 3291 protruding out from the top end 321 to receive outside power and a second contact 3292 disposed on the sunken portion 323 to connect with the first conducting member 315 through the socket unit 328 to transfer the power.

According to the embodiment as shown in FIGS. 3A and 3B in combination with FIGS. 5A, 5B and 5C, the connector 32 embedded in the cavity 313 is modular and can be secured to the adapter body 31 by way of the sliding plate 3161 protruding in the second opening 313*b*, urging against and blocking the second connecting member 327. In other embodiments without protrusion blocks on the corners of the connector 32, the connector side wall 324 facing the second opening 313*b* is possible to be urged against and blocked by the sliding plate 3161 directly (not shown). This structure restrains the embedded connector 32 from moving toward the second opening 313*b* by the sliding plate 3161 and from moving toward the first opening 313*a* by the engagement between the first connecting member 314 and the second connecting member 327, and may thoroughly secure the connector 32 to the adapter body 31. In addition, the present invention can also solve the positioning problem in the prior art and make the electrical contact between the connector 32 and the adapter body 31 more precisely to increase safety in use.

As shown in FIGS. 5A, 5B and 5C, the first contact 3291 formed by part of the second conducting member 329 protruding out from the top end 321 comprises two pins to receive outside power, and is coupled to the second contact 3292, which is capable of connecting with the first conducting member 315 of the adapter body 31 to transfer the power. The construction of the second conducting member 329 embedded in the sunken portion 323 is arranged as L in shape in response to the variable assembly direction of the connector 32 to keep conductive between the contacts in all possible assembly directions in coupling the connector 32 to the adapter body 31.

In one preferred embodiment, a stopper 318 is also available to be included in the adapter body 31. The stopper 318 here is two bumps disposed on the bottom base 313*c* of the cavity 313 adjacent to the first conducting member 315 so as to protect the conducing member 315. In some cases, the stopper 318 may also be constructed for the use of preventing any unintended connectors from entering into the cavity 313 in order to protect the first conducting member 315. In response to the stopper 318, the bottom end 322 on the connector 32 is configured to provide two slits 326 as the sliding channels for receiving the stopper 318 in coupling. It is understood that the stopper 318 is possible to be constructed in many different and similar ways known to the skilled one in the art.

Figure 7:
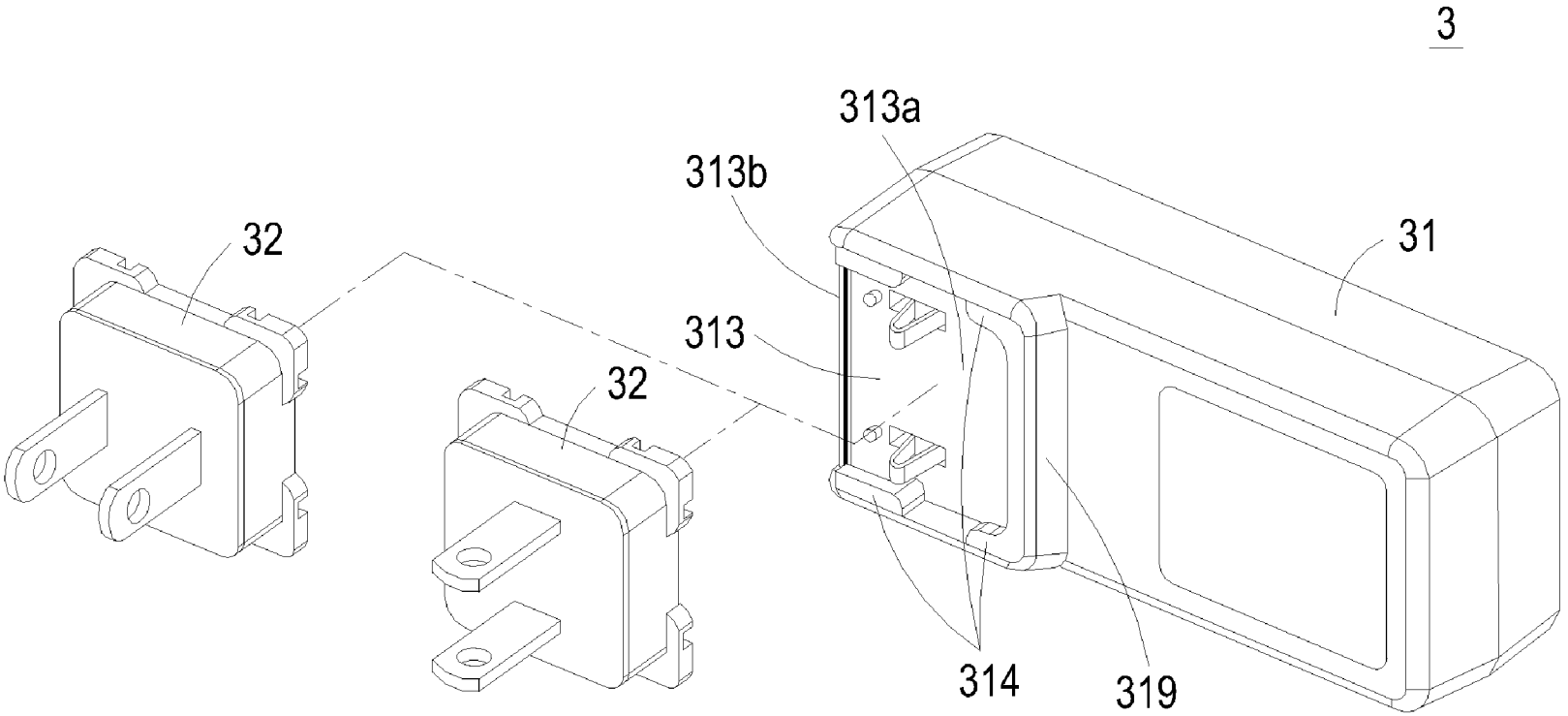
FIG. 7 illustrates an exploded view of a power adapter schematically showing a way to connect the adapter body with the interchangeable connector when stoppers are placed according to one embodiment of the invention.

FIG. 7 is an exploded view illustrating a power adapter equipped with the stopper 318 according to one embodiment of the invention. In particular, the adapter body 31 further comprises a projecting wall 319 protruding out from the first lateral wall 311 to enclose and define the cavity 313. The first connecting member 314 is formed adjacent to the rim of the cavity 313. The cavity 313 forms the first opening 313*a* on the first lateral wall 311, and the second opening 313*b* on the second lateral wall 312.

Figure 8B:
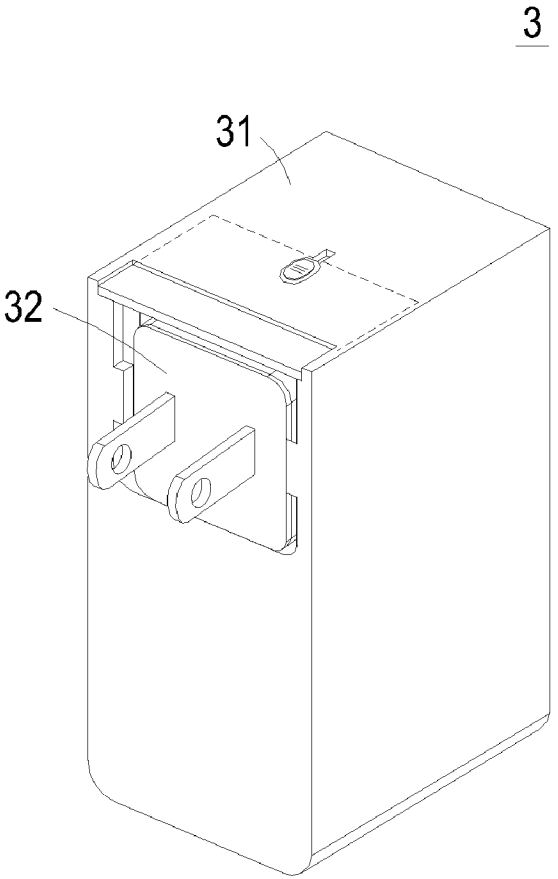
FIG. 8B is an assembled view schematically showing the power adapter as in FIG. 8A.
Figure 8A:
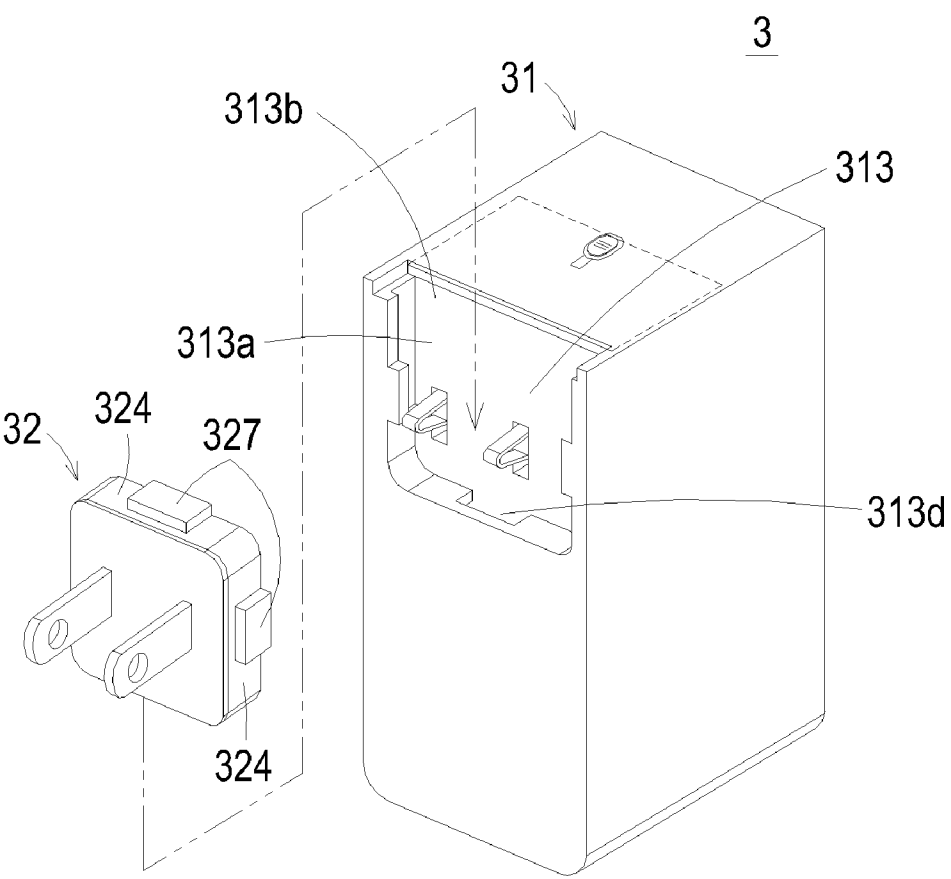
FIG. 8A is an exploded view of a power adapter schematically showing one another way to connect a variant adapter body with a variant interchangeable connector according to one embodiment of the invention.

FIGS. 8A and 8B respectively illustrate an exploded view and an assembly view of a power adapter according to one another embodiment similar to the one as shown in FIGS. 3A and 3B. In particular, the cavity 313 of the adapter body 31 further includes a recess 313*d* opposite to the second opening 313*b* to be engaged with the second connecting member 327, and the protrusion blocks of the second connecting member 327 are symmetrically arranged on the side walls 324 away from the corners. The assembly direction of the connector 32 is also variable in this embodiment.

Figure 9B:
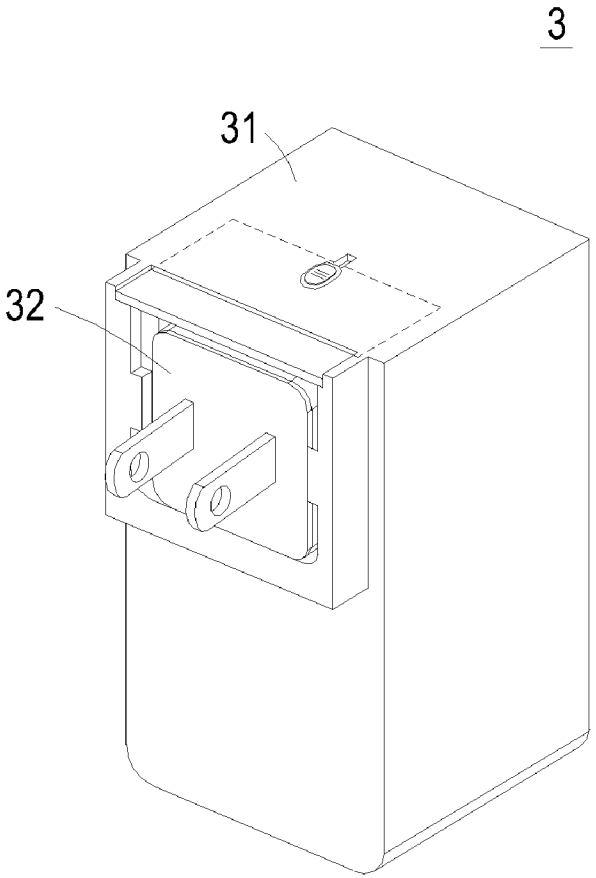
FIG. 9B is an assembled view schematically showing the power adapter as in FIG. 9A.
Figure 9A:
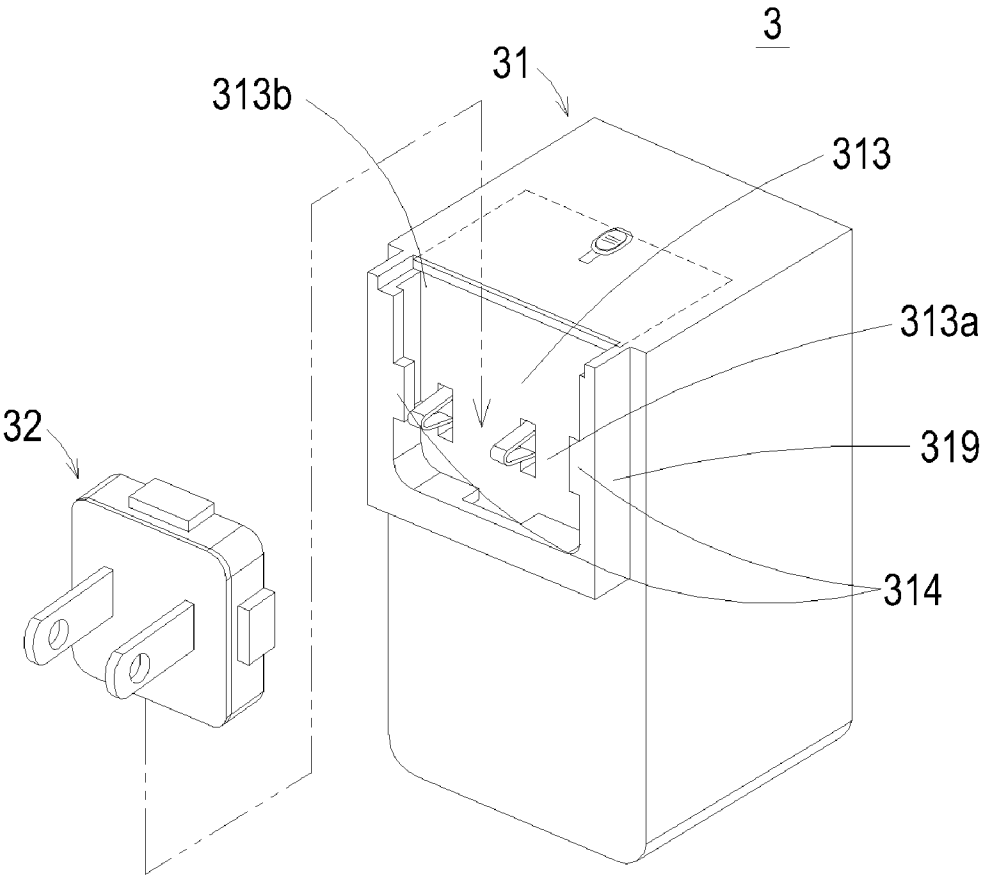
FIG. 9A is an exploded view of a power adapter schematically showing one another way to connect a variant adapter body with a variant interchangeable connector according to one embodiment of the invention.

FIGS. 9A and 9B respectively illustrate an exploded view and an assembly view of a power adapter according to one another embodiment which is similar to the embodiment as shown in FIG. 7 in combination with the embodiment as illustrated in FIGS. 8A and 8B. There is a projecting wall 319 protruding out from the first lateral wall 311 to enclose and define the cavity 313. The first connecting member 314 is formed adjacent to the rim of the cavity 313. The cavity 313 forms the first opening 313*a* on the first lateral wall 311, and the second opening 313*b* on the second lateral wall 312. The assembly direction of the connector 32 is also variable.

The power adapter of the present invention is capable to be used in a power supply when an additional power conversion circuit is added. The power conversion circuit is placed inside the adapter body and coupled with the first conducting member 315 for receiving and supplying power.

From the above description, the present invention provides a power adapter and power supply, in which the coupling between the connector and the housing is secure, the connector is firmly enclosed by the housing, and the electrical safety can be improved. In addition, the connector is capable of being fully positioned so as to transfer reliable power. The connectors are modularized and the conducting terminals of the connectors are specially designed to comply with various connector regulations so that the power adapter is more user-friendly and easily stored. Moreover, the orientation of the connector is changeable according to the practical requirements so that the space utilization is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power adapter comprising:

an adapter body comprising a first lateral wall, a second lateral wall adjacent to said first lateral wall, a cavity forming a first opening on said first lateral wall, a second opening on said second lateral wall and having a bottom base, a first connecting member disposed on said first lateral wall and adjacent to a rim of said first opening of said cavity, a sliding plate member having a sliding plate embedded in a slide of said second lateral wall and protrusible in said second opening, and a first conducting member disposed on said bottom base of said cavity; and a connector interchangeably coupled to said cavity and having a second conducting member and a second connecting member, wherein said second conducting member is coupled to said first conducting member;

wherein said sliding plate member comprises a holding unit which is an elastic component placed inside said adapter body and coupled with said sliding plate for holding said sliding plate; said sliding plate is configured to urge against said connector for restraining said connector from moving toward said second opening; and said second connecting member is configured to engage with said first connecting member for restraining said connector from moving toward said first opening.

2. The power adapter according to claim 1, wherein said sliding plate member comprises a position controller coupled with said sliding plate for managing the projecting position of said sliding plate in said second opening.

3. The power adapter according to claim 1, wherein said first connecting member comprises a flange and a plurality of breaches, and a guiding groove is formed between said first connecting member and said bottom base of said cavity.

4. The power adapter according to claim 3, wherein said connector is embedded in said cavity by said second connecting member entering into said guiding groove from either said first opening between said plurality of breaches, or said second opening.

5. The power adapter according to claim 1, wherein said connector comprises:

a top end;

a bottom end opposite to said top end; and a plurality of connector side walls along with said top end enclosing a sunken portion, and having said second connecting member extended outwardly.

6. The power adapter according to claim 5, wherein said second connecting member is a plurality of protrusion blocks placed on either said connector side walls or the four corners thereof.

7. The power adapter according to claim 6, wherein said second connecting member of said connector is urged against and blocked by said sliding plate protruded in said second opening to restrain said connector from moving toward said second opening.

8. The power adapter according to claim 5, wherein said adapter body comprises a stopper disposed on said bottom base adjacent to said first conducting member and said bottom end of said connector has a plurality of slits configured to be the sliding channels for receiving said stopper in coupling.

9. The power adapter according to claim 1, wherein said cavity further comprises a recess disposed oppositely to said second opening.

10. The power adapter according to claim 1, wherein said connector is a modular connector.

11. A power supply comprising:

an adapter body comprising a first lateral wall, a second lateral wall adjacent to said first lateral wall, a cavity forming a first opening on said first lateral wall, a second opening on said second lateral wall and having a bottom base, a first connecting member disposed on said first lateral wall and adjacent to a rim of said first opening of said cavity, a sliding plate member having a sliding plate embedded in a slide and protrusible in said second opening, and a first conducting member disposed on said bottom base;

a power conversion circuit placed inside said adapter body and coupled with said first conducting member for receiving and supplying power; and a connector interchangeably coupled to said cavity and having a second conducting member and a second connecting member, wherein said second conducting member comprising a first contact for receiving power from an external power source and a second contact coupled with said first conducting member;

wherein said sliding plate member comprises a holding unit which is an elastic component placed inside said adapter body and coupled with said sliding plate for holding said sliding plate; said sliding plate is configured to urge against said connector for restraining said connector from moving toward said second opening; and said second connecting member is configured to engage with said first connecting member for restraining said connector from moving toward said first opening.

12. The power supply according to claim 10, wherein said sliding plate member comprises a position controller coupled with said sliding plate for managing the projecting position of said sliding plate in said second opening.

13. The power supply according to claim 10, wherein said first connecting member comprises a flange and a plurality of breaches, and a guiding groove is formed between said first connecting member and said bottom base of said cavity.

14. The power supply according to claim 13, wherein said connector is embedded in said cavity by said second connecting member entering into said guiding groove from either said first opening between said plurality of breaches, or said second opening.

15. The power supply according to claim 10, wherein said connector comprises:

a top end;

a bottom end opposite to said top end; and a plurality of connector side walls along with said top end enclosing a sunken portion, and having said second connecting member extended outwardly.

16. The power supply according to claim 15, wherein said second connecting member is a plurality of protrusion blocks placed on either said connector side walls or the four corners thereof.

17. The power supply according to claim 16, wherein said second connecting member of said connector is urged against and blocked by said sliding plate protruded in said second opening to restrain said connector from moving toward said second opening.

18. The power supply according to claim 15, wherein said adapter body comprises a stopper disposed on said bottom base adjacent to said first conducting member and said bottom end of said connector has a plurality of slits configured to be the sliding channels for receiving said stopper in coupling.

* * * * *